US006419370B1

(12) United States Patent
Chen

(10) Patent No.: US 6,419,370 B1
(45) Date of Patent: Jul. 16, 2002

(54) BOOK LAMP STRUCTURE

(76) Inventor: Chung-Yang M. Chen, 3F, No. 2, Lane 497, Chung-Cheng Rd., Hsintien City, Taipei County (TW)

( * ) Notice: Subject to any disclaimer, the term of this patent is extended or adjusted under 35 U.S.C. 154(b) by 0 days.

(21) Appl. No.: 09/765,617

(22) Filed: Jan. 22, 2001

(51) Int. Cl.[7] ..... F21L 15/20

(52) U.S. Cl. ..... 362/98; 362/287; 362/396; 362/421

(58) Field of Search ..... 362/98, 157, 287, 362/191, 418, 419, 427, 396, 421

(56) References Cited

U.S. PATENT DOCUMENTS 4,432,042 A * 2/1984 Zeller ..... 362/183
5,180,220 A * 1/1993 Van Kalsbeek ..... 362/98
5,463,538 A * 10/1995 Womack ..... 362/106

* cited by examiner

*Primary Examiner*—Sandra O'Shea
*Assistant Examiner*—John Anthony Ward
(74) *Attorney, Agent, or Firm*—Bacon & Thomas, PLLC

(57) ABSTRACT

Book lamp structure including a lamp main body, a pivot unit and a base seat. One end of the lamp main body is pivotally connected with the pivot unit. The pivot unit is composed of a connecting member, a supporting rod and a ball joint section disposed on the base seat. One end of the connecting member is axially connected with the lamp main body, while the other end thereof is transversely pivotally connected with the supporting rod, whereby the lamp main body can be rotated about an axis normal to the connecting member and pivotally tilted up and down relative to the supporting rod. The other end of the supporting rod is formed with a spherical section which is pivotally connected with the ball joint of the base seat, whereby the supporting rod as well as the lamp main body can be rotated about the axis of the supporting rod and tilted forward and backward and leftward and rightward and freely universally adjust the angle of the book lamp.

5 Claims, 5 Drawing Sheets

BOOK LAMP STRUCTURE

BACKGROUND OF THE INVENTION

1. Field of the Invention

The present invention is related to an improved book lamp which has simpler structure and can be freely universally adjusted in angle.

2. Description of the Related art

A conventional small-size reading lamp is composed of a lamp shade and a base seat connected with the lamp shade via a connecting member such as a flexible tube. In use, the base seat of the reading lamp is fixed on a certain position by a clip member. By means of bending the flexible tube, the lamp shade can be adjusted to get close to an article such as a book to illuminate the book for reading. However, the conventional reading lamp has some shortcomings as follows: The lamp shade is connected with the base seat via the connecting member which is frequently bent to support the lamp shade at a certain angle. After a period of use, the connecting member is liable to loosen from or even detach from the lamp shade. Moreover, the connecting member is exposed to outer side and the appearance of the reading lamp as a whole is monotonous and poor. U.S. Pat. Nos. 4,432,042 granted on Feb. 14, 1984 discloses an improved reading lamp which is composed of a lamp support, a stem and a clip seat. A lamp casing is disposed at one end of the lamp support, in which a bulb is mounted for emitting light. A bendable stand is disposed on the other side of the lamp support. A sleeve is pivotally connected with the end of the stand and axially fitted with the stem. The stem is pivotally disposed on the clip seat which clips a book or papers. By means of the above structure, the lamp support can be bent up or down and forward or rearward and moved left or right. However, such reading lamp still some shortcomings as follows:

1. When using the reading lamp, a user often will move his/her body and change his/her attitude. Therefore, the light often fails to normally project onto the book. The stem is such connected with the clip seat that the stem can be only bent up or down. In addition, the clip seat is fixed with the book. Therefore, as a whole, the lamp support can be only bent forward or backward or transversely rotated. As a result, when the user's body deflects and necessitates a laterally tilting angle of the reading lamp, the reading lamp can be hardly adjusted to get as close to the book as possible. Therefore, it is inconvenient to use such reading lamp.
2. The reading lamp has numerous pivot sections and joints for multi-directionally adjust the reading lamp. Therefore, the reading lamp has complicated structure and is liable to damage.

SUMMARY OF THE INVENTION

It is therefore a primary object of the present invention to provide an improved book lamp structure including a lamp main body, a pivot unit pivotally connected with the lamp main body and a base seat. The pivot unit is composed of a connecting member, a supporting rod and a ball joint section disposed on the base seat. One end of the connecting member is axially connected with the lamp main body, while the other end thereof is transversely pivotally connected with the supporting rod, whereby the lamp main body can be rotated about an axis normal to the connecting member and pivotally tilted up and down relative to the supporting rod. The other end of the supporting rod is formed with a spherical section which is pivotally connected with the ball joint of the base seat, whereby the supporting rod as well as the lamp main body can be rotated about the axis of the supporting rod and tilted forward and backward and leftward and rightward and freely universally adjust the angle of the book lamp. The book lamp has simplified structure, while being more flexibly adjustable.

It is a further object of the present invention to provide the above book lamp structure in which a power supply is externally connected with the book lamp to reduce the total weight thereof and thus reduce the load placed on the user when clipping a book.

The present invention can be best understood through the following description and accompanying drawings wherein:

DETAILED DESCRIPTION OF THE PREFERRED EMBODIMENT

Figure 1:
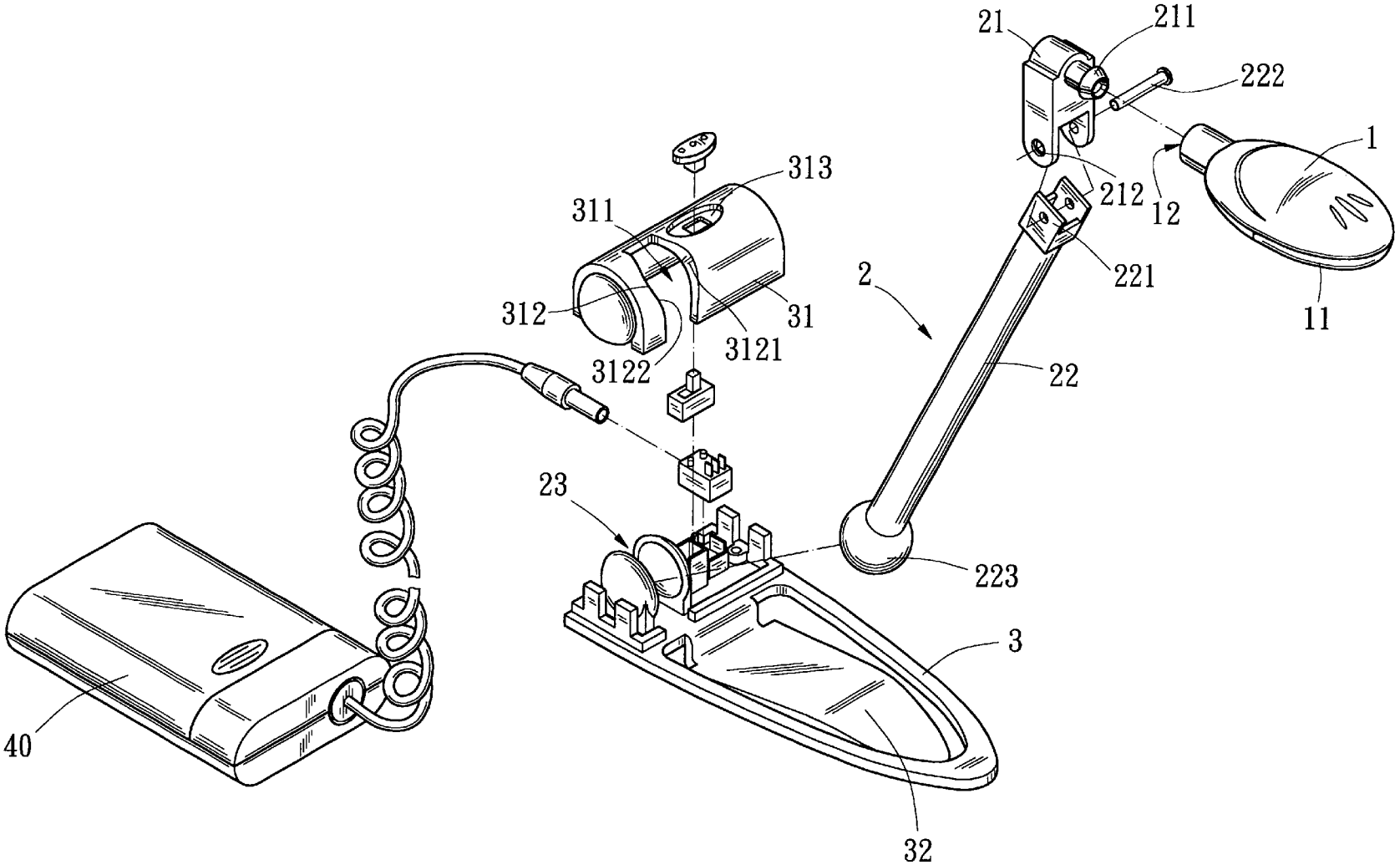
FIG. 1 is a perspective exploded view of the book lamp of the present invention.
Figure 2:
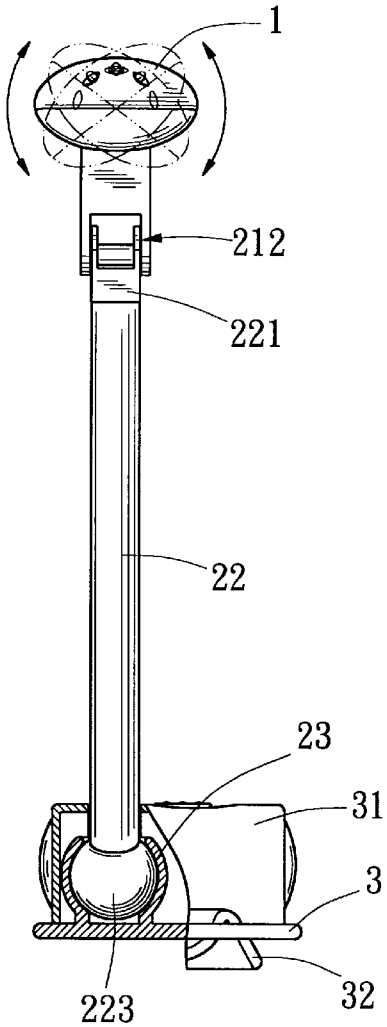
FIG. 2 shows the adjustment of the book lamp of the present invention in one state.
Figure 3:
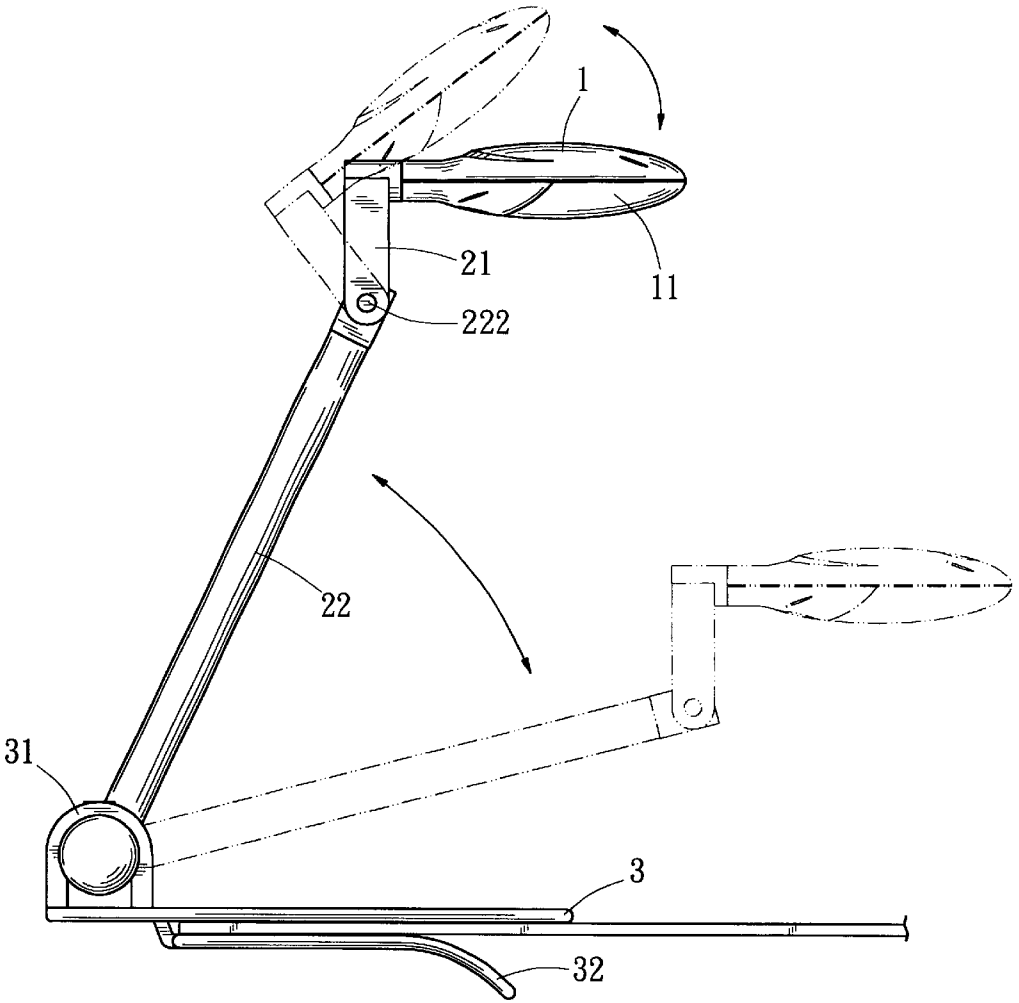
FIG. 3 shows the adjustment of the book lamp of the present invention in another state.
Figure 4:
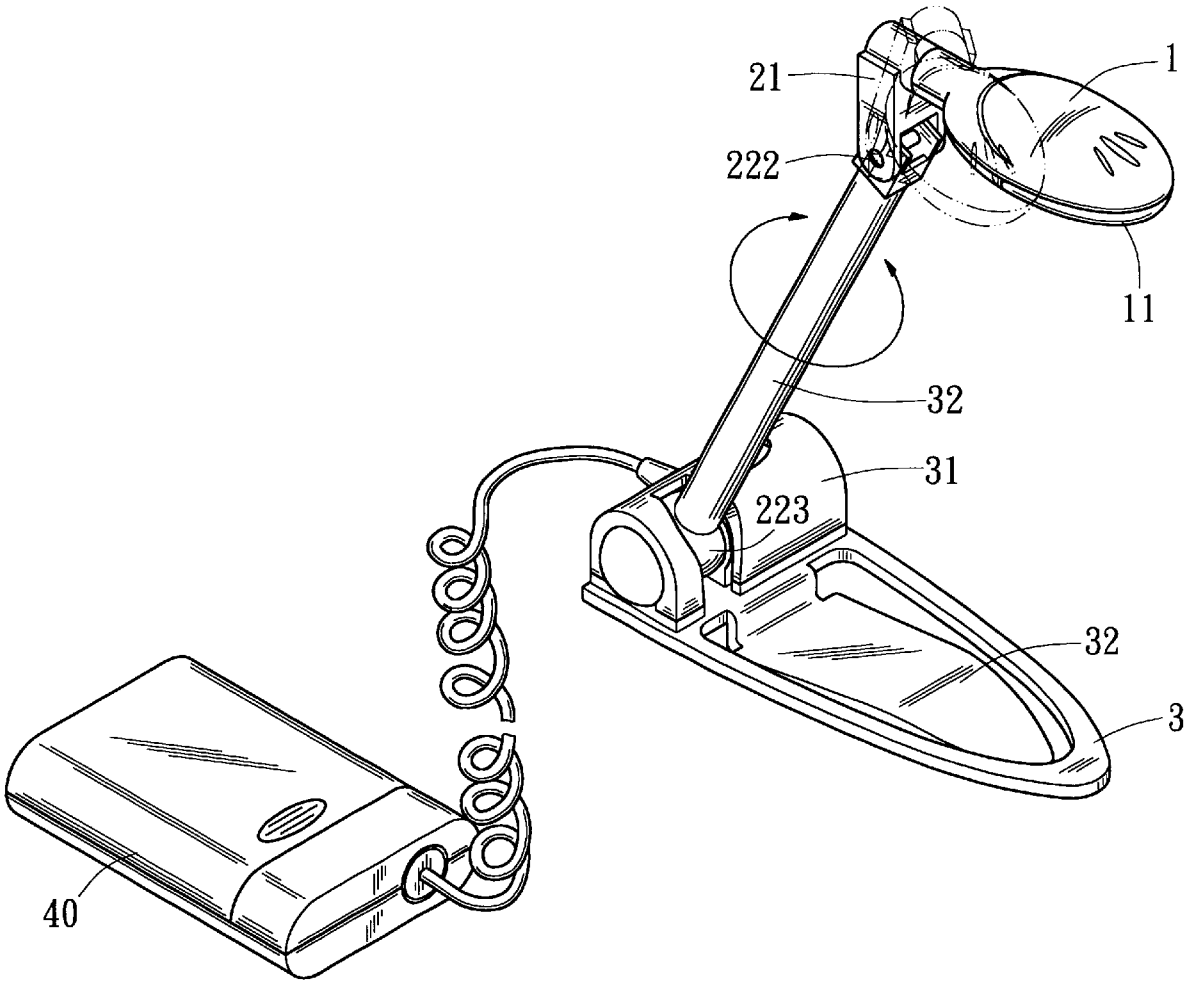
FIG. 4 shows the adjustment of the book lamp of the present invention in still another state.
Figure 5:
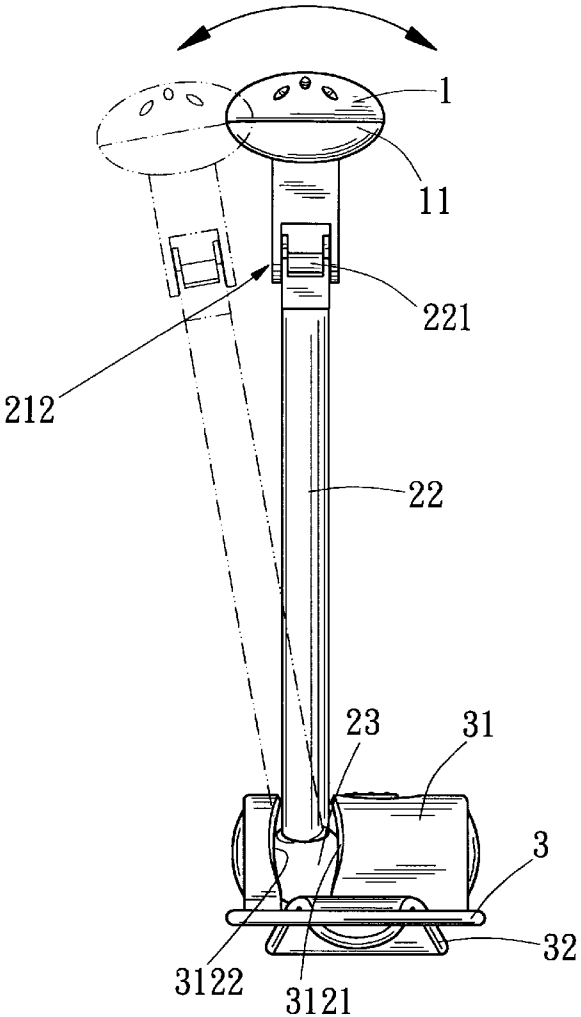
FIG. 5 shows the adjustment of the book lamp of the present invention in still another state.

Please refer to FIG. 1. The book lamp structure of the present invention includes a lamp main body 1, a pivot unit 2 and a base seat 3. The lamp main body 1 is a casing having a lamp shade 11 at front end as illuminating section of the reading lamp. The other end of the lamp main body 1 is equipped with a socket section 12. The pivot unit 2 is composed of a connecting member 21, a supporting rod 22 and a ball joint section 23. One end of the connecting member 21 is formed with a plug section 211 and a pivot section 212. The plug section 211 can be inserted into the socket section 12 of the lamp main body 1, whereby the lamp main body 1 can be rotated and adjusted about the axis of the plug section 211 (as shown in FIG. 2). One end of the supporting rod 22 is formed with a transverse pivot section 211 pivotally secured to the pivot section 212 of the connecting member 21 by a pin 22 (as shown in FIG. 1), whereby the connecting member 21 can be pivotally rotated and adjusted up and down relative to the supporting rod 22. Accordingly, the lamp main body 1 can be rotated about an axis normal to the connecting member 21 and pivotally tilted up and down relative to the supporting rod 22 (as shown in FIGS. 2 and 3). In addition the other end of the supporting rod 22 is formed with a spherical section 223 pivotally partially clamped by two concave petal-like halves of the ball joint section 23. The base seat 3 is composed of a housing 31 and a clip member 32 extending from front side of the base seat 3. The housing 31 defines therein a chamber 311 in which the ball joint section 23 and electric elements are received. The housing 31 is formed with an arch split 312 defined between two laterally expanded arch edges 3121, 3122. The arch split 312 has a profile corresponding to the supporting rod 22 and the ball joint section 23 connected therewith. Therefore, by means of the pivotal connection between the spherical section 223 of the supporting rod 22 and the ball joint section 23, the supporting rod 22 can be rotated about the axis of the supporting rod 22 and tilted forward and backward and leftward and rightward relative to the base seat 3. Accordingly, within the arch split 312 of the housing 31, the supporting rod 22 can be rotated and multi-directionally adjusted with the ball section 23 serving as the fulcrum (as shown in FIGS. 3, 4, and 5). The housing 31 is further formed with a window 313 for mounting a switch such as a press button therein. The clip member 32 serves to clip a book or paper. According to the above arrangement, the connecting member 21 and the main body 1 can be rotated about the axis thereof or pivotally tilted up and down. In addition, by means of the pivotal connection between the spherical section 233 of the supporting rod 22 and the ball joint section 23, the supporting rod 22 (or the lamp main body) can be rotated about the axis of the supporting rod 22 and multi-directionally tilted forward and backward and leftward and rightward relative to the base seat 3. Therefore, the book lamp can be universally adjusted in angle.

Moreover, the book lamp has light weight so that when clipping a book or papers, a user will not suffer heavy load in reading. The power supply 40 is externally connected with the book lamp so as to reduce the weight of the book lamp.

The above embodiment is only used to illustrate the present invention, not intended to limit the scope thereof. Many modifications of the above embodiment can be made without departing from the spirit of the present invention.

What is claimed is:

1. A book lamp comprising:

a lamp main body having a lamp shade as an illuminating section, one end of the lamp main body being equipped with a socket section;

a pivot unit composed of a connecting member, a supporting rod and a ball joint section, one end of the connecting member being formed with a plug section and a pivot section, the plug section being axially inserted into the socket section of the lamp main body such that the lamp main body is rotatable on the pivot section, the pivot section being transversely and pivotally connected with the supporting rod, whereby the lamp main body is rotatable about an axis normal to the connecting member and pivotally tilted up and down relative to the supporting rod;

a base seat composed of a housing and a clip member, the housing serving to supply power for the book lamp, the clip member adapted for clipping an article; and one end of the supporting rod of the pivot unit is formed with a spherical section and a ball joint section is disposed on the base seat corresponding to the spherical section by the pivotal connection between the spherical section of the supporting rod and the ball joint section, the supporting rod is rotatable about the axis of the supporting rod and tilted forwards, backwards, leftwards and rightwards relative to the base seat.

2. A book lamp as claimed in claim 1, wherein the ball joint section is composed of two concave petal-like halves, the spherical section of the supporting rod being partially clamped by the two concave halves, whereby the supporting rod can be pivotally rotated within the ball joint section.

3. The book lamp as claimed in claim 1, wherein the housing defines therein a chamber and is formed with an arch split defined between two laterally expanded arch edges, the arch split having a profile corresponding to the supporting rod and the ball joint section connected therewith, whereby within the arch split, the supporting rod can be rotated about the axis of the supporting rod and tilted forwards, backwards, leftwards and rightwards on the ball joint section of the base seat.

4. The book lamp as claimed in claim 1, wherein the housing is formed with a window for mounting a switch.

5. The book lamp as claimed in claim 1, wherein a power supply is externally connected with the base seat for supplying power for the book lamp.

* * * * *